US006607378B2

(12) United States Patent
Harneit et al.

(10) Patent No.: US 6,607,378 B2
(45) Date of Patent: Aug. 19, 2003

(54) IGNITION FLAME FOR GAS COOKING BURNERS

(76) Inventors: Uwe Harneit, 1466 W. Francis Ave., Ontario., CA (US) 91762-6016; Humberto Delgado, 9072 Acaso Dr., Temple City, CA (US) 91780

( * ) Notice: Subject to any disclaimer, the term of this patent is extended or adjusted under 35 U.S.C. 154(b) by 163 days.

(21) Appl. No.: 09/933,484

(22) Filed: Aug. 20, 2001

(65) Prior Publication Data

US 2002/0034713 A1 Mar. 21, 2002

Related U.S. Application Data

(60) Provisional application No. 60/232,873, filed on Sep. 15, 2000.

(51) Int. Cl.[7] ..... F23D 14/62; F23Q 3/00; B05B 1/14

(52) U.S. Cl. ..... 431/354; 431/266; 239/560; 239/561; 126/39 E

(58) Field of Search ..... 431/266, 354, 431/286, 349; 126/39 E, 214 R; 239/560, 561, 554, 555, 556, 565

(56) References Cited

U.S. PATENT DOCUMENTS

| | | | | |
|---|---|---|---|---|
| 4,891,006 A | | 1/1990 | Le Monnier de Gouville | |
| 4,968,246 A | | 11/1990 | Sesada et al. | |
| 5,328,357 A | | 7/1994 | Riehl | |
| 5,405,263 A | | 4/1995 | Gerdes et al. | |
| 5,464,004 A | | 11/1995 | Maughan | |
| 5,649,822 A | * | 7/1997 | Gertler et al. | 431/354 |
| 5,690,483 A | * | 11/1997 | Oda et al. | 431/266 |
| 5,800,159 A | * | 9/1998 | Maughan et al. | 431/349 |
| 5,899,681 A | | 5/1999 | Maughan | |
| 5,924,860 A | | 7/1999 | Massey et al. | |
| 6,132,205 A | * | 10/2000 | Harneit | 431/354 |
| 6,244,263 B1 | * | 6/2001 | Schlosser et al. | 126/39 R |

* cited by examiner

*Primary Examiner*—Alfred Basichas
(74) *Attorney, Agent, or Firm*—Lewis M Brande; Thomas A. McCleary; Brande and McCleary

(57) ABSTRACT

This invention describes an ignition flame for a gas cooking burner that uses an ignition flame system to reignite a gas burner when the burner's flame is extinguished due to drafts or cross winds, when the gas burner is set on very low settings, even in the presence of a side wind.

5 Claims, 3 Drawing Sheets

IGNITION FLAME FOR GAS COOKING BURNERS

This application claim benefit to provisional application 60/232,873 filed Sep. 15, 2000.

BACKGROUND OF THE INVENTION

1. Field of the Invention

A vast majority of cooking burners that are used on gas cooking appliances have burner caps which have two (2) rows of openings around their circumference. The openings generally take the form of either bored holes or slots which allow a gas-air mixture to pass through. The gas-air mixture is ignited on the outer circumference of the burner. The gas-air mixture can be ignited by a timed spark ignition, Piezo ignition, or if the flames are extinguished by wind, automatic re-ignition.

Most current designs of burners contain an upper cap that contains an upper flame ring. The upper flame ring is constructed so that there is direct communication to an inner chamber of the burner. The holes or slots are designed and dimensioned in order to make sure that the sharpest possible burning flame is generated. The problem with the sharpest possible burning flame is that the flame has the tendency to "tear" away from the burner, and therefore become extinguished.

One solution to prevent "tear away" is to add an additional narrow annular gap that is cut into the outer portion of the burner, which is left open under the flame ring. On two-part or multi-part burners, this annular gap is normally designed to feed to the outside diameter of the burner through either of the small slots or holes bored penetrating into the inner chamber of the burner. These holes or small slots are not usually visible on the assembled burner. The gas-air mixture flows through these small slots or holes in an annular gap between the base of the burner and the burner ring and exits evenly through this annular gap on the outside diameter of the burner and flows around the circumference of the burner.

The main flame ring, is actually defined by a number of individual flames running around the burner circumference, is maintained by this very small surrounding ring of flame. (which is also described as the supporting flame ring)

When a burner is operating on a very low setting, the main flames become shorter and cannot burn as sharply. At this low setting, the supporting flame is very close to being extinguished. In this very low setting, re-ignition of the burner flames is difficult if there is even a slight side wind.

The basic problem was to achieve re-ignition, even in the burner's low position.

2. Description of the Prior Art

U.S. Pat. No. 4,891,006 by de Gouville et al., dated Jan. 2, 1990 discloses a pilot flame gas burner and burner cap. In this disclosure, a pilot flame collar is created around the periphery of the burner without projecting appreciably from the peripheral surface of the burner, which is susceptible to side winds. This invention does not incorporate a sustaining flame nor an ignition flame, as does the current invention.

U.S. Pat. No. 4,968,246 by Sasada et al. describes a heating apparatus comprising a burner body with an air-fuel mixture chamber and a burner cap with a plurality of flame ports, a top plate and a trivet on the top plate. The heating apparatus was designed to allow the apparatus to continue operating after liquid is spilled on the burner, but makes no allowance for side winds affecting the apparatus. Also, this burner design differs from the current invention in that it has a main flame ring and a separate inner flame versus the main flame ring, supporting flame ring and ignition flame of the current invention.

U.S. Pat. No. 5,328,357 by Riehl dated Jul. 12, 1994 shows a burner construction and a method of making the burner. The burner construction consists of a burner body with a chamber therein and a cap closing one end of the burner body. The burner body has an annular surface interrupted by a plurality of radially disposed grooves. This construction, however, does not reveal or teach a narrow annular ring between the burner base and the flame ring to create a flame ring, as in the current invention. Nor does it show the main flame, supporting flame and ignition flame of the current invention.

U.S. Pat. No. 5,405,263 by Gerdes et. al. dated Apr. 11, 1995 discloses a sealed gas burner assembly having a ring portion that sits on the main top portion around the periphery of the main top aperture through which the burner extends. The ring portion forms a tight seal with the main top to prevent liquids from running down through the burner assembly in the main top. A burner body and a cap supported by the burner body form a chamber which receives a mixture of gas and air. The gas/air mixture issues from ports in the side wall of the burner body, where it is ignited to produce a cooking flame. The construction of this burner is considerably different from the current invention in that it lacks a burner head and uses it's flame to heat a main top, instead of directly heating a pot or pan from the flames. Also, this invention is for use on a gas range and, once again, does not reveal the main flame, sustaining flame and ignition flame system of the current invention.

U.S. Pat. No. 5,464,004 by Maughan dated Nov. 7, 1995 reveals an atmospheric gas burner having a diffusion pilot. Unlike the current invention, which mixes air and fuel to create a pilot flame, the Maughan invention directs a small portion of the total fuel to the burner, without air. Atmospheric air mixes with the fuel allowing the flame to withstand a high drop in air pressure. Also, this invention does not reveal a burner base, a main flame ring, a sustaining flame ring, an ignition flame, an ignition electrode and a burner cap to protect a flame ring from side winds. The current invention mixes the air/fuel mixture inside a distribution chamber before igniting the respective flames versus the Maughan invention which mixes the air/fuel outside of the burner assembly.

U.S. Pat. No. 5,899,681, also by Maughan (supra, U.S. Pat. No. 5,464,004) dated May 4, 1999 shows an atmospheric gas burner assembly for connection to a source of gas comprising a burner body with a sidewall and a main gas conduit. The main gas conduit has a burner throat and the sidewall has a top surface with a plurality of sidewall islands with a plurality of opposing ridges defining a plurality of carryover slots between the opposing ridges, the top surface and a burner cap. The plurality of carryover slots reduce the velocity of an air/fuel mixture and allegedly produce low velocity, stable flame. As noted above (U.S. Pat. No. 5,464,004) this invention does not reveal a burner base, a main flame ring, a sustaining flame ring, an ignition flame, an ignition electrode and a burner cap to protect a flame ring from side winds. Again, the current invention mixes the air/fuel mixture inside a distribution chamber before igniting the respective flames, whereas the Maughan invention mixes the air/fuel outside of the burner assembly.

U.S. Pat. No. 5,924,860 by Massey et al. dated Jul. 20, 1999 describes a thickwall gas burner assembly. The gas burner assembly includes a burner base with and inlet to receive a mixture of gas and air. A burner cap rests on the burner base, defining a burner fuel chamber. The burner cap has a plurality of main burner ports where the air/gas mixture exits and is ignited by a spark ignition assembly. Unlike the current invention which incorporates an annular gap between the burner base and the flame ring in conjunction with the main flame ring, sustaining flame ring and ignition flame system to prevent extinction of the flame ring by a side wind, the Massey invention incorporates an ignition pocket in the burner cap for reigniting captured gas in the event of a side wind or draft. Also, this burner is designed for gas stoves, as opposed to a gas barbeque.

SUMMARY OF THE INVENTION

The following description is provided to enable a person skilled in the art to make and use the invention and sets forth the best modes contemplated by the inventor for carrying out his invention. Various modifications, however, will be readily apparent to those skilled in the art, since the generic principles of the present invention have been defined herein specifically to provide for an improved adjustable gas pressure regulator.

The present invention offers a solution to the problem as described above under Field of the Invention. The gas quantity of the supporting flame ring is relocated in such a way that the gas quantity is increased by 2 or 3 additional small flames, which blend together in front of an ignitor. The purpose of the ignitor is to achieve ignition of the flame ring, while the centrally located flame provided on the outside of the burner presents no direct connection to the main flame ring or the supporting flame ring.

An ignition flame allows the gas-air mixture necessary for ignition to emerge directly to or adjacent to the ignitor. To prevent the ignition flame from being blown away, due to a slight side wind or draft of air, one or more holes are bored into the lower part of a burner ring, beneath the holes for the ignition flame. These holes increase the quantity of the flammable gas-air mixture in the area of the ignition flame and thus increases the gas quantity to the supporting flame ring adjacent to the ignition flame.

Above the ignition flame, both a main flame ring and the supporting flame ring are ignited, since the ignition flame comes in contact with the air/gas mixtures coming from the main flame ring and the supporting flame ring, respectively.

BRIEF DESCRIPTION OF THE DRAWINGS

The objects and features of the present invention, which are believed to be novel, are set forth with particularity in the claims. The present invention, both as to its organization and manner of operation, together with further objects and advantages, may be best understood by reference to the following description, taken in connection with the accompanying drawings, in which:

DETAILED DESCRIPTION

Figure 1:
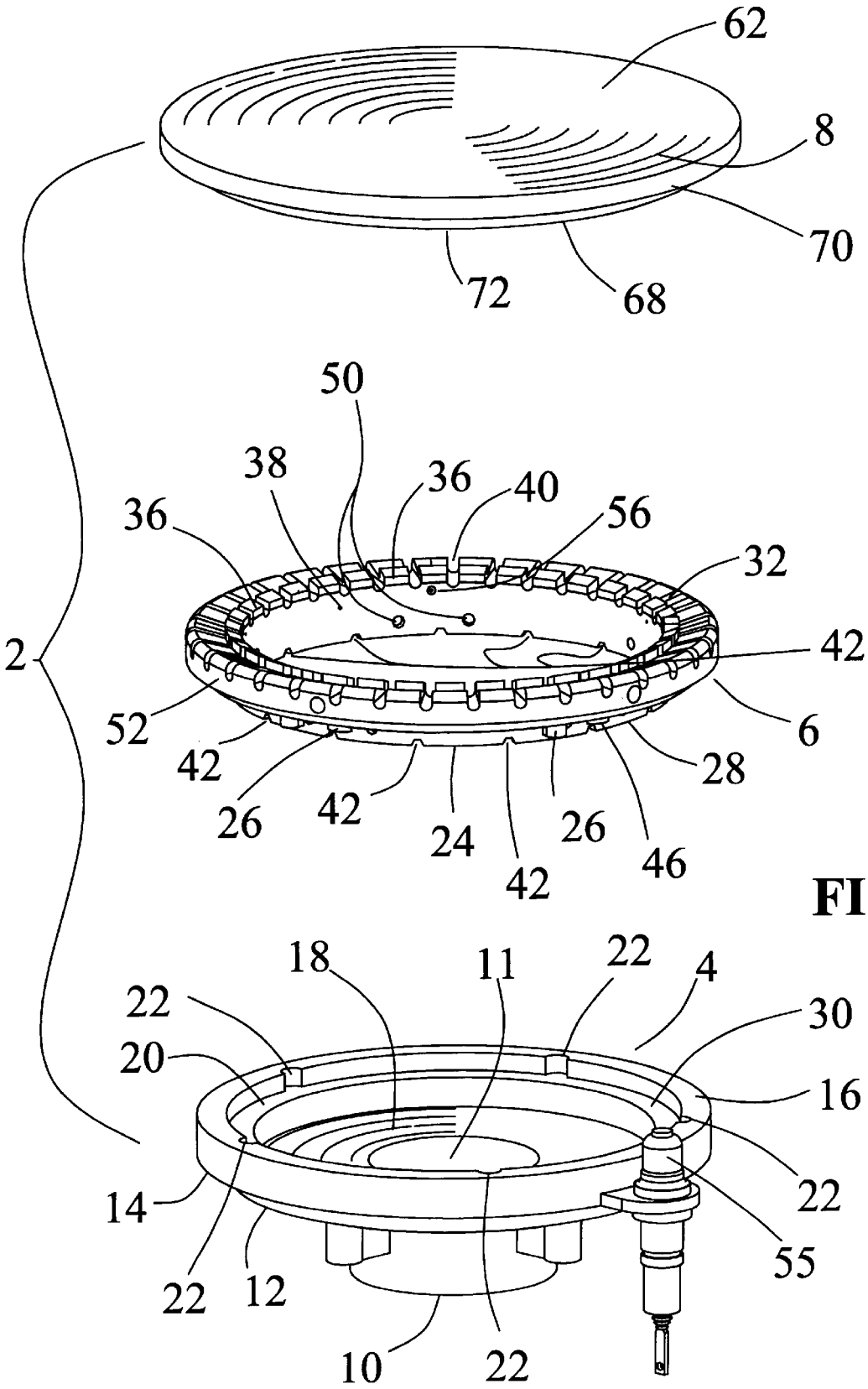
FIG. 1 shows an exploded view of the burner showing a burner base with an ignition electrode attached, a burner ring, and a burner cap

With respect to FIG. 1, a gas burner (2) comprises a burner base (4), a burner ring (6) and a burner cap (8). The burner base (4) is essentially disk shaped and has a central boss (10) located on a bottom surface (12) where the central boss (10) is downwards protruding. The burner base (4) has a first annular ring (14) located on a top surface (16) of the burner base (4) protruding upwards, defining a central cavity (18) therein. The first annular ring (14) of the burner base (4) has a groove (20) defined therein allowing the burner ring (6) to sit thereon. The first annular ring (14) has a multiplicity of detents (22) defined therein to positionally locate the burner ring (6) on the burner base (4). The central boss (10) has a central hole (11) defined therein allowing a gas-air mixture to communicate with the central cavity (18).

The burner ring (6) is ring shaped, and has a second annular ring (24) that protrudes downwards and may be slip fit into the first annular ring (14) of the burner base (4). Surrounding the second annular ring (24) area are a plurality of locating bosses or cams (26) that are complimentary in shape to the multiplicity of detents (22) located in the first annular ring (14) of the burner ring (4). The plurality of locating bosses (26) fit in the multiplicity of detents (22) positionally locating the burner ring (6) in the burner base (4). A lower surface (28) of the second annular ring (24) of the burner ring (6) sits on a first surface (30) located on the groove (20) of the burner base (4). A first upper surface (32) of the burner ring (6) is tapered and has a third annular ring or positioning ring (36) located in proximity to an inner surface (38) of the burner ring (6) which defines a means to locate and position the burner cap (8). The first upper surface (32) of the burner ring (6) has a multiplicity of main flame slots (40) equally spaced and circumferentially defined therein, where each of the multiplicity of main flame slots (40) is oriented parallel to the taper of the first upper surface (32) of the burner ring (6). The multiplicity of main flame slots (40) defined in the burner ring (6) create a main flame ring (82). The lower surface (28) of the second annular ring (24) has a multiplicity of sustaining flame slots (42) equally spaced and circumferentially defined therein. The multiplicity of sustaining flame slots (42) define a sustaining flame ring (84). Also surrounding the second annular ring (24) are a second plurality of positioning bosses or cams (46) that spatially position the burner ring (6) within the burner base (4) and thereby allow the burner base (4) and the burner ring (6) to define an constant gap or distribution chamber (48) therebetween. The second annular ring (24) has a multiplicity of pairs of ignition support flame holes (50) defined therein. Each pair of ignition support flame holes (50) straddles the second plurality of positioning bosses or cams (46). The burner ring (6) has an outer surface (52), where the outer surface (52) has a diameter similar to that of the burner base (4). The burner ring (6) has a multiplicity of ignition flame support holes (54) defined therein, the multiplicity of ignition flame support holes (54) are grouped in pairs (58), where the number of pairs (58) of ignition flame support holes (54) may equal the number of positioning bosses or cams (26). An ignition flame hole (56) is positioned generally midway between the pair (58) of the multiplicity of ignition flame support holes (54) thereby positioning an ignition flame hole (56) by an ignition source or igniter (55) and one of the pair (58) of the multiplicity of ignition flame support holes (54), regardless of the radial positioning of the burner ring (6). The ignition flame hole (56) penetrates the outer surface (52) of the burner ring (6) to the inner surface (38) of the burner ring. The ring shape of the burner ring (6) creates a distribution chamber (60) therebetween, the distribution chamber (60) and the central cavity (18) communicating with each other, thereby allowing a gas-air mixture to communicate therewith, the distribution chamber (60), the distribution chamber (60) leading to a flame outlet (86) said flame outlet (86) being located between said burner base (2) the burner ring (6), thereby allowing a gas-air mixture to communicate with the main flame slots (40), the sustaining flame slots (42), the ignition flame support holes (58), and the ignition flame hole (56).

The ring shape of the burner ring (6) creates a second distribution chamber (60) therebetween, the second distribution chamber (60) and the central cavity (18) of the burner base (4) communicate with each other, thereby allowing a gas-air mixture to be distributed from the second distribution chamber (60),where the second distribution chamber (60) leads to a flame outlet (86), said flame outlet (86) being located between said burner base (2) and the burner ring (6), thereby allowing a gas-air mixture to be distributed to the main flame slots (40), the sustaining flame slots (42), the ignition flame support holes (58), and the ignition flame hole (56).

The burner cap (8) is essentially disk shaped and has an upper surface (62) and a lower surface (64). The overall diameter of the burner cap (8) is greater than either the burner base (4) or the burner ring (6). A fourth annular ring (68) is centrally positioned on the lower surface (64) of the burner cap (8) and is inset from an outer edge or ledge (70) of the burner cap (8). This allows the burner cap (8) to overhang the burner ring (6) creating a larger diameter main flame ring(82). The fourth annular ring (68) has a lower surface (72) where the lower surface (72) of the fourth annular ring (68) is of a shape complimentary to the first upper surface (32) of the burner ring (6). The fourth annular ring (68) of the burner cap (8) has a diameter greater than that of the third annular ring (36) of the burner ring (8), which centrally positions and locates the burner cap (8) in relation to the burner ring (6) thereby defining the means to position and locate the burner cap (8). The burner cap (8) is of a density great enough to prohibit easy removal of the burner cap (8) from the gas burner (2) and creates a tight seal to the burner ring (6).

Figure 2:
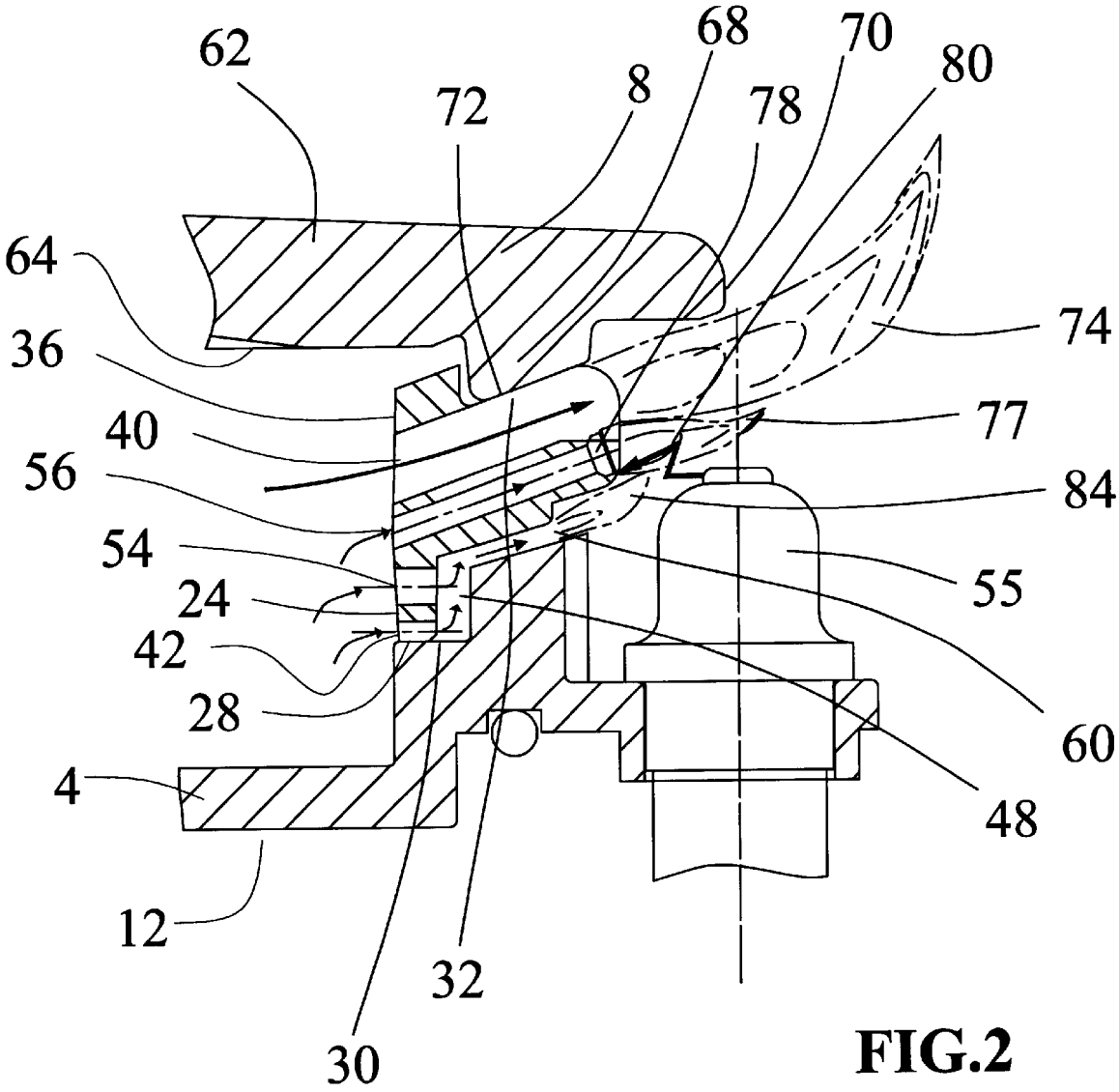
FIG. 2 shows a cross sectional view of an assembled burner assembly, depicting the main flame and the sustaining flame

FIG. 2 shows a cross section through the gas burner (2). The gas-air mixture present in the second distribution chamber (60) is shown being distributed through the main flame slots (40) creating a series of main flames (74). The gas-air mixture penetrates through the sustaining flame slots (42) located between the burner base (4), the burner ring (6), and into a distribution chamber (48) defined between the burner base (4) and the burner ring (6). The gas-air mixture also flows through the ignition support flame holes (58), located in the burner ring (6), creating an ignition support flame (76) which is necessary to maintain an ignition flame (77) for the gas burner (2).

The gas-air mixture from the second distribution chamber (60) for the ignition flame (77) flows through the ignition flame hole(56). The ignition flame hole (56) has a counterbore (78) at its exit for better flame maintenance.

The exiting gas-air mixture of the ignition flame (77) has direct contact with the supporting flame (79) and at least one main flame (74) of the main flame ring (82). The supporting flame (79) in turn has direct contact with the ignition flame (77) and itself blends with the supporting flame ring (84).

An ignition spark (80) from the igniter (52) is conducted to a point on the outside edge (81) of the counterbore (78) located at the exit of the ignition flame hole (56).

Figure 3:
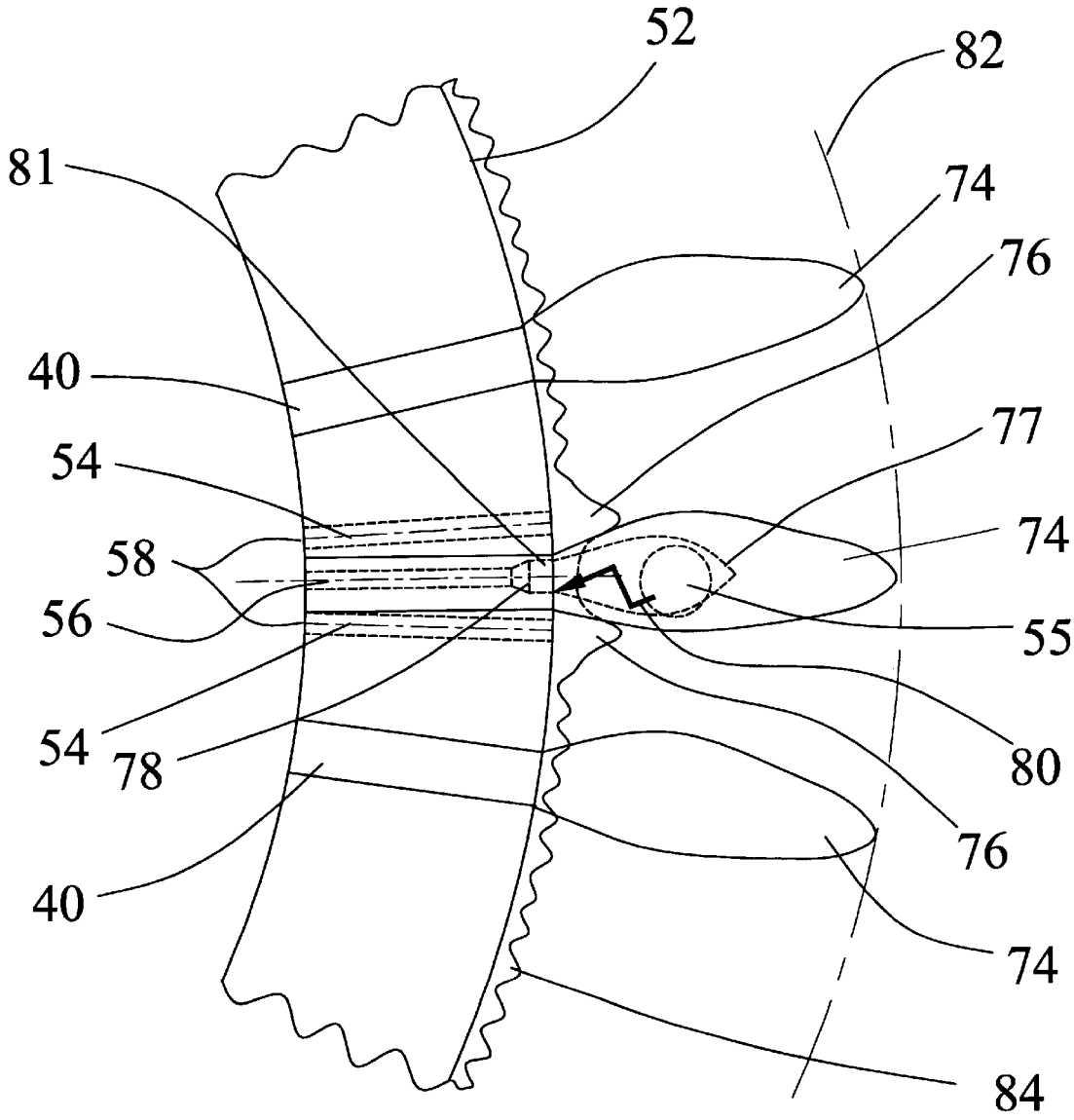
FIG. 3 shows the main flame ports and the sustaining flame ports

FIG. 3. shows a downward view or flame view of the individual exit openings on the burner, where the main flames (74) from the main flame ring (82) are located in the upper area of the burner (2). FIG. 3 also shows the supporting flame ring (84) that is increased in the area of the ignition flame (77) by the supporting flame (79). The ignition flame (77) is ignited via the ignitor (52) by an ignition spark (80).

What is claimed is:

1. An ignition flame for gas cooking burners, comprising:

a) a burner base, said burner base being essentially disk shaped and having a bottom surface, a central boss, said central boss being located on said bottom surface and protruding downwards, said burner base further having a top surface and a first annular ring, said first annular ring being located on said top surface and protruding upwards creating a central cavity therein, said first annular ring having a groove defined therein, said groove allowing a burner ring to be positioned thereon, said annular ring having means to radially locate said burner ring, said central boss having a central hole defined therein allowing a gas-air mixture to communicate with said central cavity;

b) said burner ring being essentially ring shaped and having a second annular ring protruding downwards, a first upper surface, an outer surface and an inner surface, said second annular ring having a bottom surface, said bottom surface of said second annular ring having a multiplicity of sustaining flame slots equally spaced and circumferentially defined therein, said bottom surface of said second annular ring resting on said groove of said burner base, said top surface of said burner ring being tapered and having a third annular ring located in proximity to said inner surface of said burner ring, said first upper surface of said burner ring having a multiplicity of main flame slots defined therein, said second annular ring having a multiplicity of pairs of ignition support flame holes defined therein, each pair of said multiplicity of pairs of ignition support flame holes straddling a means to spatially position said burner ring in said burner base creating a distribution chamber therebetween, said distribution chamber leading to a flame outlet, said flame outlet defining a sustaining flame ring, said burner ring further having a multiplicity of ignition flame holes defined therein, each of said multiplicity of ignition flame holes being located generally midway between each pair of ignition support flame holes, said ignition flame holes penetrating said outer surface and said inner surface of said burner ring, said burner ring having a means to locate said ignition flame hole near an ignition means; and c) a burner cap, said burner cap being essentially disk shaped having an upper and a lower surface, said burner cap having a fourth annular ring centrally positioned on said lower surface of said burner cap, said fourth annular ring having a lower surface, said lower surface of said fourth annular ring having a shape complementary to said first upper surface of said burner ring, centrally locating said burner cap within said burner ring and enclosing said gas-air distribution chamber, said burner cap creating a main flame ring from said multiplicity of main flame slots when said burner cap is positioned on said burner ring.

2. The ignition flame for a gas cooking burner, as in claim 1, wherein:

said ignition flame consists of the gas-air mixture from said ignition flame hole having direct contact with said supporting flame and said main flame ring and at least one flame from said multiplicity of pairs of ignition support flames.

3. The ignition flame for gas cooking burners, as in claim 1, wherein:

said means to radially locate said burner ring within said burner cap consists of said first annular ring consists of a multiplicity of detents defined therein; and said means to locate said ignition flame hole near said ignition means consists of a plurality of locating bosses, said plurality of locating bosses being complimentary in shape to said multiplicity of detents defined in said first annular ring, said plurality of locating bosses fitting within said plurality of detents radially locating said burner ring in said burner base and positioning said ignition flame hole in proximity to said ignition means.

4. The ignition flame for gas cooking burners, as in claim 1, wherein:

said means to spatially position said burner ring in said burner base comprises a second plurality of positioning cams, said second plurality of positioning cams surround said second annular ring of said burner ring centrally positioning said burner ring within said burner base and creating said distribution chamber therebetween.

5. The ignition flame for gas cooking burner, as in claim 1, wherein:

said multiplicity of said ignition flame slots have a counterbore defined therein, said counterbore being located at each ignition flame hole enlarging the exit of said ignition flame hole to provide better flame maintenance for said ignition flame.

* * * * *